United States Patent [19]

Moyer

[11] 4,120,148

[45] Oct. 17, 1978

[54] LOGIC CIRCUIT FOR USE IN TWO OR THREE BUTTON DIGITAL WATCH

[75] Inventor: Norman E. Moyer, Newport Beach, Calif.

[73] Assignee: Hughes Aircraft Company, Culver City, Calif.

[21] Appl. No.: 710,494

[22] Filed: Aug. 2, 1976

[51] Int. Cl.[2] ..... G04B 27/00

[52] U.S. Cl. ..... 58/85.5; 58/23 R

[58] Field of Search ..... 58/23 R, 23 A, 23 D, 58/50 R, 85.5

[56] References Cited

U.S. PATENT DOCUMENTS

| | | | |
|---|---|---|---|
| 3,871,170 | 3/1975 | Bergey | 58/50 R |
| 3,984,973 | 10/1976 | Ho | 58/50 R |

*Primary Examiner*—Robert K. Schaefer
*Assistant Examiner*—Vit W. Miska
*Attorney, Agent, or Firm*—Fay I. Konzem; W. H. MacAllister

[57] ABSTRACT

A logic circuit subsection of a digital watch integrated circuit (IC) chip which enables the final watch electronics module to determine whether it is in a two or three button watch. The IC chip then uses this information to alter the pushbutton responses so that it is appropriate for either a two or three button watch.

The logic circuit of the present invention consists of a plurality of logic gates in combination with latching means which cause the digital watch to be in either a two or three button mode.

In the two button digital watch, by placing the batteries in the watch the circuit of the present invention causes the watch to be in the two button mode, and to thereby function as a two button watch. Simultaneous depression of both of the watch's buttons will also cause the watch to be in the two button mode.

In the three button watch, depression of the third button will cause the watch to be in the three button mode and to thereby function as a three button watch.

4 Claims, 4 Drawing Figures

LOGIC CIRCUIT FOR USE IN TWO OR THREE BUTTON DIGITAL WATCH

BACKGROUND OF THE INVENTION

1. Field of the Invention

This invention relates to digital electronic watches, and more particularly, to a digital watch having one integrated circuit (IC) chip which may be used in either a two or three button digital watch.

2. Description of the Prior Art

In the art, it has been necessary to manufacture one integrated circuit chip to be used in a two button digital watch and a different integrated circuit chip to be used in a three button digital watch. Naturally, having to manufacture two different IC chips was more expensive than if one IC chip could be manufactured for both the two and the three button digital watches.

The circuit of the present invention senses whether it is in a watch case containing two or three push buttons and causes the watch to be in either the two button mode, i.e., to function as a two button watch or to be in the three button mode and to function as a three button watch. Therefore, the circuit of the present invention enables production of only one IC chip that is suitable for use in either a two or three button digital watch.

SUMMARY OF THE INVENTION

The circuit, in accordance with the invention, consists of a plurality of logic gates in combination with latching means which cause the digital watch to operate in either the two or three button mode depending upon whether the circuit is in a watch case containing two or three push buttons.

In the two button watch by placing the batteries in the watch case the circuit of the present invention causes the watch to be in the two button mode, i.e., to function as a two button watch; simultaneous depression of the two buttons will also cause the watch to function in the two button mode.

In the three button watch depression of the third button will cause the watch to function in the three button mode, i.e., as a three button watch.

Accordingly, it is an object of the present invention to provide a circuit which will allow one integrated circuit chip to be used in either a two or three button digital watch.

It is another object to provide a circuit which will cause a digital watch to function as a two button watch when the batteries are placed in the watch.

It is a further object to provide a circuit which will cause a digital watch to function as a two button watch by the simultaneous depression of the watch's two push buttons.

In addition, it is an object to provide a circuit which will cause a digital watch to function as a three button watch upon depression of a third push button.

The features of the present invention which are believed to be novel, are set forth with particularity in the appended claims. The present invention, both as to its organization and manner of operation together with further objects and advantages thereof, may be understood best by reference to the following description, taken in connection with the accompanying drawings.

DETAILED DESCRIPTION

Figure 1:
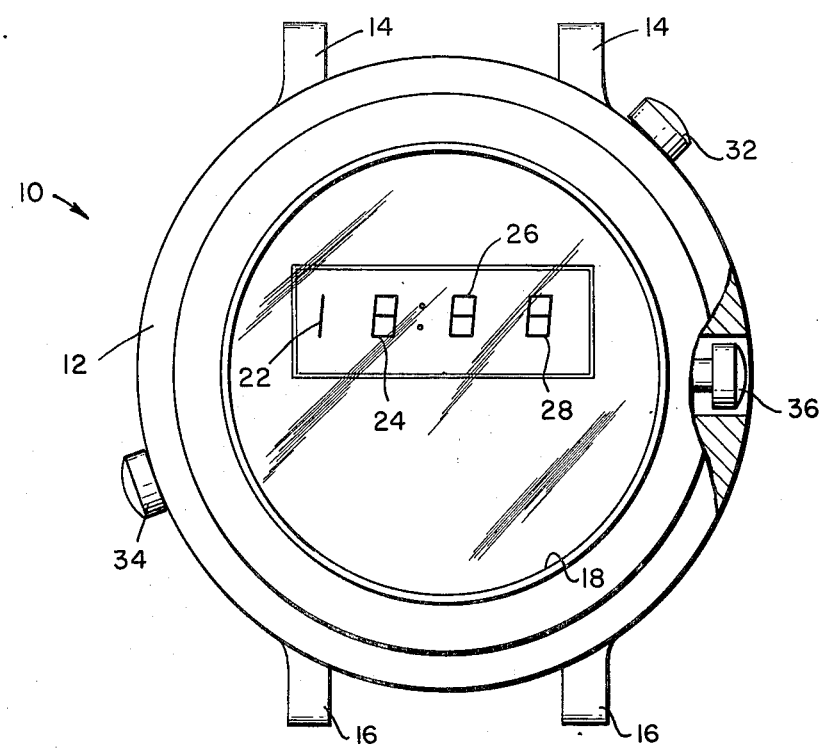
FIG. 1 is a top-plane view of a three button LED digital watch.

Referring now to FIG. 1, the digital watch 10 has a case 12 which is provided with watch strap-securing ears 14 and 16. The securing ears 14 and 16 are of such a nature that the usual watch strap can be attached thereon so that the watch 10 can be carried upon the wrist of the wearer. Crystal 18 is mounted on the front of the watch case 12. The display elements 22, 24, 26 and 28 are each a standard seven-segment display, which when energized, selectively represent the 10 digits from 0–9. The display is controlled by means of manually operated push buttons 32 and 34. The logic circuit of this invention could be used in combination with either a light emitting diode (LED) or a liquid crystal (LC) display. The digital watch in this specification will refer to a LED display.

Watch case 12 carries manually operable push buttons 32 and 34, which are easily accessible. Furthermore, case 12 carries recessed push button 36 which can be depressed by a pointed object for the purpose of setting the clock by affecting the horological data appearing at the display.

In the digital watch of FIG. 1, operating button 32 selects the hours-minutes and seconds and recessed button 36 is used to set the horological information. One depression of operating push button 32 displays the hours-minutes information on display devices 22–28, continued depression of push button 32 will result in the seconds information being displayed on display devices 22–28. Depression of operating push button 34 displays the date information on the display devices and continued depression of push button 34 will result in the display devices continuing to display the date information. Simultaneous depression of buttons 32 and 34 will cause the display of "hands-off" seconds. By "hands-off" seconds is meant that the display devices will display the counting seconds without further contact from the watch user, the counting seconds will continue to be displayed on the LED devices until either push button 32 or 34 is again depressed until a timer on the IC chip turns the display devices off.

Figure 2:
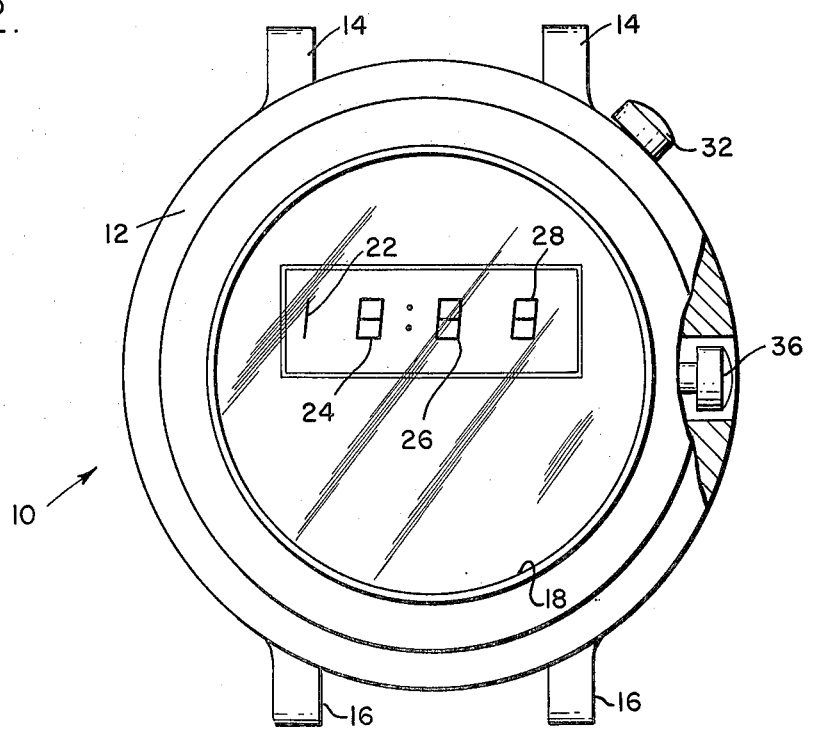
FIG. 2 is a top-plane view of a two button LED digital watch.

In FIG. 2, digital watch 10 is constructed similarly to that of the digital watch of FIG. 1 except that the watch of FIG. 2 has only two buttons; manually operable push button 32 and recessed button 36. The two button watch of FIG. 2 functions in the same manner as the three button watch of FIG. 1 for hours-minutes and seconds. However, two pushes of button 32 are required for date information (hold for continuous display) and three pushes are required for "hands-off" seconds.

Figure 3:
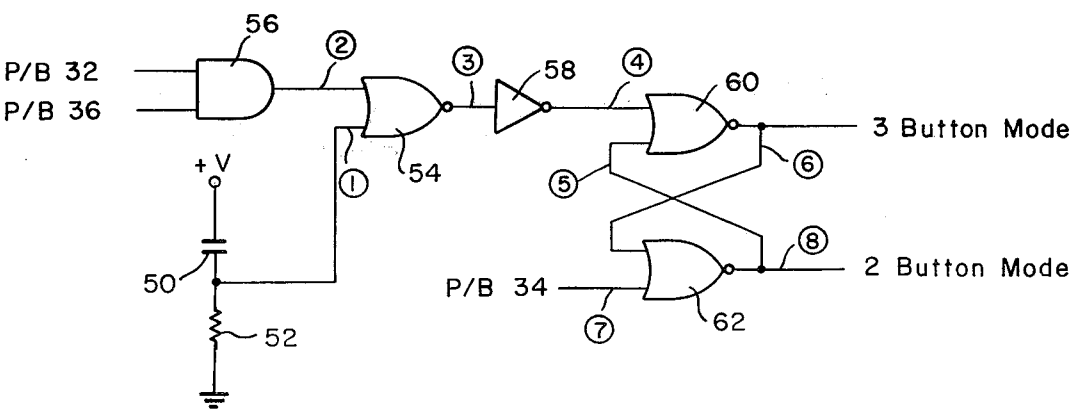
FIG. 3 is a circuit diagram of the circuit of the present invention.

FIG. 3 shows the circuit of the present invention, which allows one integrated circuit chip to be used in either a two button watch of FIG. 2 or the three button digital watch of FIG. 1. A positive voltage is delivered from the digital watch's batteries through capacitor 50 to resistor 52 and to a first input to NOR gate 54. The purpose of this RC network is to deliver a positive pulse to NOR gate 54 when power is first applied to the circuit. This function is often called a "power-on reset." AND gate 56 has a first input connected to push button 32 and a second input connected to recessed button 36 and an output connected to a second input to NOR gate 54. The output of NOR gate 54 is connected through inverter 58 to a first input to NOR gate 60. Cross-coupled NOR gates 60 and 62 form latching means which either put the watch in a two button or a three button mode. In the two button mode the digital watch functions as a two button watch. And, in the three button mode, the digital watch functions as a three button watch. A second input to NOR gate 62 is connected to operating push button 34.

Figure 4:
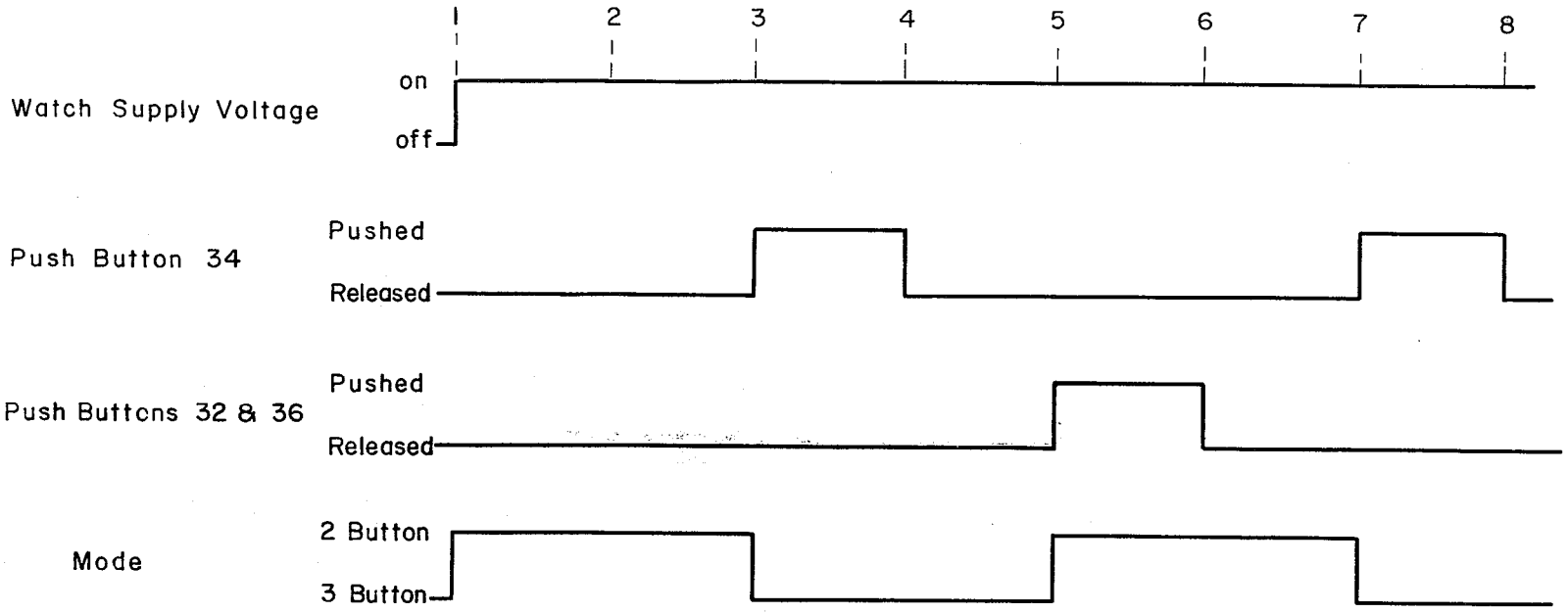
FIG. 4 is a timing diagram illustrating the operation of the circuit of the present invention.

The operation of the circuit of FIG. 3 can be better understood by referring to the timing diagram of FIG. 4 in connection with FIG. 3. When batteries are placed in the digital watch a high binary level signal (logic 1) is instantaneously seen by the first input to NOR gate 54 at point 1. Therefore, the output of NOR gate 54, at point 3, is at a low binary level and the output of inverter 58, at point 4, is at a high binary level. This in turn causes NOR gate 60 to output a low binary level signal. Since push button 34 is not depressed, the second input to NOR gate 62, at point 7, is at a low binary level which produces a high signal at the output of NOR gate 62, which in turn causes the digital watch to be in the two button mode. After the batteries are placed in the watch the instantaneous high level signal delivered by capacitor 50 will return to a low level binary signal which will be delivered to the first input to NOR gate 54, the output of NOR gate 54 thereby delivering a high binary level signal to an inverter 58 (push buttons 32 and 34 are not being depressed) which in turn delivers a low signal to NOR gate 60. The output of NOR gate 60 is still at a low binary level and the output of NOR gate 62 is still at a high binary level, continuing to cause the digital watch to be in the two button mode.

When push button 34, of the three button digital watch is depressed, a high binary level signal is delivered to the second input of NOR gate 62, at point 7. Therefore, the output of NOR gate 62 changes to a low binary level. The first input to NOR gate 60 is at a low binary level and the second input of NOR gate 60, which is connected to the output of NOR gate 62, is at a low binary level; thereby, outputting a high binary level signal from NOR gate 60 and placing the digital watch in the three button mode.

The digital watch can also be placed in the two button mode by the simultaneous depression of buttons 32 and 36 which will output a high binary level signal to the second input of NOR gate 54 which, in turn, will output a low binary level signal to inverter 58 which will invert said signal to a high binary level to be delivered to the first input of NOR gate 60. The output of NOR gate 60 will be at a low binary level and the second input to NOR gate 62 will be at a low binary level. Therefore, the output of NOR gate 62 will be at a high binary level and the watch will be in the two button mode. The signals from gates 60 and 62 are used to cause other circuitry to select the pushbutton response that is appropriate.

Although the device which has just been described appears to afford the greater advantages for implementing the invention, it will be understood that various modifications may be made thereto without going beyond the scope of the invention, it being possible to replace certain elements by other elements capable of fulfilling the same technical functions therein.

What is claimed is:

1. A method of allowing the same IC chip to be used in different digital watches with differing numbers of push buttons, which comprises:

(a) providing circuitry to initialize the digital watch's logic to operate as a watch with a predetermined number of push buttons when batteries are inserted into the watch case, the batteries permitting a predetermined number of push buttons to be operable; and (b) providing circuitry to detect the depression of additional push buttons thereby causing the watch to function appropriately for the additional push buttons and permitting said additional push buttons to be operable.

2. The methd of claim 1 wherein depressing the two push buttons simultaneously initializes the logic in the same manner as applying power.

3. A logic circuit in a digital watch which allows the same integrated circuit chip which contains the watch's electronics to be used both in a watch having first and second pushbutton-actuated switches and in a watch having an additional pushbutton-actuated switch, said circuit comprising:

an AND gate having first and second inputs respectively connected to said first and second switches, said AND gate also having an output;

an inverter having an input and an output;

a first NOR gate having a first input connected to the output of said AND gate, a second input, and an output connected to the input of said inverter;

a bistable latch including second and third NOR gates, each having a pair of inputs and an output, with the output of each of said NOR gates being connected to a first one of the inputs of the other of said NOR gates, and with the output of said inverter being connected to the second one of the inputs of said second NOR gate;

means for normally applying a first logic voltage to the second one of the inputs of said third NOR gate so as to set said latch in one of its stable states and thereby to place the integrated circuit chip in an operating mode compatible with operation under the control of said first and second pushbutton-actuated switches; and means for applying a second logic level voltage to said second input of said third NOR gate in response to actuation of said additional pushbutton-actuated switch, so as to set said latch in the other of its stable states and thereby to place said integrated circuit chip in an operating mode compatible with operation under the control of all three of said pushbutton-actuated switches.

4. The logic circuit of claim 3 further comprising a capacitor and a resistor connected in series at a node between a reference voltage and ground, said node being connected to the second input of said first NOR gate.

* * * * *